US008118292B2

(12) United States Patent
Zhang

(10) Patent No.: US 8,118,292 B2
(45) Date of Patent: Feb. 21, 2012

(54) OPERATION TABLE WITH TELESCOPIC TABLE BOARD POSITIONED WITH ECCENTRIC ROCKER

(75) Inventor: Jian Yuan Zhang, Suzhou (CN)

(73) Assignee: Suzhou Pica Aluminum Industry, Ltd, Suzhou (CN)

( * ) Notice: Subject to any disclaimer, the term of this patent is extended or adjusted under 35 U.S.C. 154(b) by 864 days.

(21) Appl. No.: 12/087,877

(22) PCT Filed: Oct. 8, 2006

(86) PCT No.: PCT/CN2006/002613

§ 371 (c)(1), (2), (4) Date: Aug. 4, 2008

(87) PCT Pub. No.: WO2007/087740

PCT Pub. Date: Aug. 9, 2007

(65) Prior Publication Data

US 2010/0156017 A1 Jun. 24, 2010

(30) Foreign Application Priority Data

Feb. 5, 2006 (CN) ..... 2006 2 0069181

(51) Int. Cl.
*B25B 1/02* (2006.01)

(52) U.S. Cl. ..... 269/139; 269/140; 269/141

(58) Field of Classification Search ..... 269/139, 269/140, 141

See application file for complete search history.

(56) References Cited

U.S. PATENT DOCUMENTS 4,735,151 A 4/1988 Bisbing
4,991,325 A 2/1991 Teduschi
5,460,392 A * 10/1995 Hansen ..... 280/32.6
6,039,421 A * 3/2000 Fulterer ..... 312/333
6,854,402 B2 * 2/2005 DuBarry et al. ..... 108/146

FOREIGN PATENT DOCUMENTS

GB 2 398 755 A 9/2004

* cited by examiner

*Primary Examiner* — Lee D Wilson
*Assistant Examiner* — Shantese McDonald
(74) *Attorney, Agent, or Firm* — Oliff & Berridge, PLC

(57) ABSTRACT

The present utility model provides an operation table with a telescopic table board positioned with an eccentric rocker. The operation table includes a table board and support feet, the support feet being positioned at both ends of the table board along the length direction. The table board is characterized by the following features: The table board includes a left table board and a right table board, which are slidely nested with each other at the inner end, and connected at the outer end to the support feet at both ends, respectively; as for the left table board and the right table board, one of them is fixedly provided with a rack, while the other with a corresponding claw clutch, which is mainly composed of a claw and a spring; the claw is provided at the head with a tooth head engaged with the corresponding rack, and at the tail with an unlocking operation handle; the claw is supported at the central part via the spring on the left table board or the right table board correspondingly provided with the claw clutch; the spring acts in the same direction with the tooth head, and the tooth head and the unlocking operation handle are eccentrically positioned on one side of the support center of the spring, thus constituting the telescopic positioning mechanism between the left table board and the right table board. The present utility model improves the table board structure of the operation table, greatly enhancing versatility of the operation table.

12 Claims, 5 Drawing Sheets

OPERATION TABLE WITH TELESCOPIC TABLE BOARD POSITIONED WITH ECCENTRIC ROCKER

FIELD OF THE UTILITY MODEL

The present utility model relates to a small operation table (or a work table, or a service table), such as a vehicle washing table, a stand table and a mini scaffold, and particularly to an operation table with a telescopic table board, that is, the table board of the operation table can be extended along the length direction, so as to satisfy different requirements for the length of the table board on various application occasions.

BACKGROUND OF THE UTILITY MODEL

A mini operation table (or a work table, or a service table) is applied on many occasions in daily life and work, such as a dedicated vehicle washing table, and a domestic mini scaffold. The most direct result from applying this operation table is to facilitate climbing operation and bring convenience to people's lives and work.

In the prior art, much improvement has been made in the structure of this small operation table for enhancing versatility and realizing humanization design, such as an operation table with foldable feet, and an operation table with telescopic feet. The operation table with foldable feet, whose support feet under the table board are designed into foldable rotating feet, has the support feet folded during transportation and storage processes, and unfolded to support while in use; the operation table with telescopic feet has the support feet of the operation table designed into telescopic feet, making height of the operation table adjustable. However, the prior design and development were made only on the feet of the operation table, and the table board of the operation table was not changed and still a traditional piece of flat plate, which has a fixed length and cannot be extended. Whereas there are different requirements for the length of the operation table board on different actual application occasions. For example, when the operation table is used as a footrest underlay of a domestic mini scaffold, the operation is generally performed in one position, and the operation table board is unnecessary to be too large, too large an operation table board not only occupying too much space but also increasing cost; when the operation table is used as a vehicle washing table, the table board is required to be designed longer because of the longer body of the vehicle, which permits people to move left and right on the operation table, and to avoid the trouble of getting down off the operation table before moving the operation table. Therefore, the prior factory operation tables are all designed for a particular application occasion with poor versatility. However, the main requirements the current consumers have for such products as domestic ladders and operation tables are high versatility, a wide application scope, and a small volume for portability. Therefore, the prior operation table has obvious shortcomings in versatility.

Contents of the Utility Model

The present utility model provides an operation table with a telescopic table board positioned with an eccentric rocker, aiming to make an improvement on the table board structure of the operation table and make the table board of the operation table telescopic, thus enhancing versatility and satisfying different requirements for the length of the table board on various application occasions.

In order to attain the above-mentioned purpose, a technical solution of the present utility model is as below: An operation table with a telescopic table board positioned with an eccentric rocker is provided, which includes the table board and support feet, the support feet being positioned at both ends of the table board along the length direction; the table board is composed of a left table board and a right table board, which are slidely nested with each other at the inner end, and connected at the outer end to the support feet at both ends, respectively; as for the left table board and the right table board, one of them is fixedly provided with a rack, while the other with a corresponding claw clutch, which is mainly composed of a claw and a spring; the claw is provided at the head with a tooth head engaged with the corresponding rack and at the tail with an unlocking operation handle, and supported at the central part via the spring on the left table board or the right table board correspondingly provided with the claw clutch; and the spring acts in the same direction with the tooth head, and the tooth head and the unlocking operation handle are eccentrically positioned on the side of the support center of the spring, thus constituting the telescopic positioning mechanism between the left table board and the right table board.

The explanation for the relevant content of the above technical solution is as below:

1. In the above solution, the rack and the claw clutch are all positioned on the side of the left table board and the right table board. As for the left table board and the right table board, one of them with the claw clutch is provided with a tooth head socket corresponding to the tooth head [9] at the head of the claw, and the tooth head is contactively engaged with the rack on the other table board through the tooth head socket.

2. In the above solution, the claw is in a point-moving state, that is, the tooth head of the claw and the rack are contactively engaged with each other in a locking state under normal conditions because of action of the spring. Trigger the unlocking operation handle when to unlock, the claw then eccentrically swings to make the tooth head escape from the rack to be in an unlocking state. Release the unlocking operation handle, and the claw is then reset and locked again.

In order to make the operation more convenient, an operator does not have to pull the unlocking operation handle all along while unlocks and adjusts the length of the table board. The following specific solution can be designed for a long-term positioning effect: The head of the claw is provided on the side where the unlocking operation handle is positioned with a bayonet, which fits the tooth head socket at the edge to get stuck and positioned, thus constituting the positioning structure of the claw in the unlocking state; moreover, the claw is provided at the central part extending toward one side on the swing plane of the claw with a locking operation handle symmetrical to the unlocking operation handle, thus the claw being in a " " form. The above-mentioned solution is to position the unlocking operation handle and the locking operation handle on both ends of the claw, respectively. When the unlocking operation handle is triggered, the claw eccentrically swings toward the side of the unlocking operation handle, making the tooth head escape from the rack to be in the unlocking state. Here the bayonet gets stuck on the edge of the tooth head socket, positioning the unlocking state. When to lock, again operate the locking operation handle on the other side to make the claw swing toward the other side to reset, and the tooth head again arrives against the rack, recovering the locking state.

3. In the above solution, the claw clutch is provided with a seat body, on which the claw is supported at the central part via the spring. The seat body is fixed on the left table board or the right table board correspondingly provided with the claw clutch.

4. In the above solution, in order to prevent the spring from deviating while the claw eccentrically swings, the following two methods can be adopted to connect the claw with the spring: a. The claw is provided at the central part with a convex platform, to which the spring is sleeved at one end; and b. the claw is directly fixedly connected at the central part with the spring at one end.

5. In the above solution, the function of the spring is to make the tooth head firmly lean against the rack, and the spring can be positioned either vertically or inclinely to the rack, vertical to the rack being the most preferred.

6. In the above solution, various prior solutions can be adopted for the support feet, which can be designed into telescopic feet or fixed feet. The junction of the support feet and the table board can be either fixed or a foldable rotary feet structure realized by rotary connection. Then the present utility model can be combined with the prior art, presenting an operation table good at both versatility and portability with the foldable and telescopic feet and the telescopic table board.

7. In the above solution, the sentence, "the left table board and the right table board are slidely nested with each other at the inner end", includes the following two specific nested connection methods: a. As for the left table board and the right table board, one of them is designed at the bottom into a chute form, while the other is nested into this chute, thus constituting slide connection. This chute can be either integrally fabricated with the table board, or additionally connected under the flat table board as an independent chute. b. The left table board and the right table board are all made up of support poles spaced in parallel with each other and connected via an outer frame, that is, the left table board and the right table board are in a grid form, comprising surface of the support pole and partition of the empty slot. When the left table board is connected with the right table board, one of them is connectively inserted with the support pole into the other at the empty slot, thus constituting slide connection.

8. In the above solution, the telescopic positioning mechanism is unlimited in number. It is generally required only to provide one telescopic positioning mechanism on one side of the table board. Certainly, one telescopic positioning mechanism can also be provided on both sides of the table board, respectively. The relative positions of the left table board and the right table board are locked under the action of the telescopic positioning mechanisms between them.

The work principle of the present utility model is as below: As shown in FIG. 1, the left table board 3 and the right table board 4 are slidely nested with each other; the right table board 4 can be arbitrarily extended along the left table board 3, and locked by the telescopic positioning mechanism when the two table boards are extended to the desired position. The locking and unlocking operation processes of the telescopic positioning mechanism are as below: Under a normal state (see FIG. 4), the tooth head 9 of the claw 7 and the rack 5 are contactively engaged with each other under the elastic action of the spring 8, showing the locking state; when to unlock, an operator (according to the arrowhead on the left in FIG. 4) triggers the unlocking operation handle 10, making the claw 7 force the spring 8 to eccentrically swing; when the spring 8 swings to a certain degree, the bayonet 13 on the claw 7 gets stuck on the edge of the tooth head socket 11 and positioned; here the tooth head 9 escapes from the rack 5, showing the locking state (see FIG. 5); then the right table board 4 can be extended, so that the overall length of the table board 1 adjusted; and when the length is adjusted in place, trigger the locking operation handle 12 on the other side of the claw 7 (according to the arrowhead on the right in FIG. 5), making the claw 7 swing to reset (according to the arrowhead in FIG. 5), recovering to the locking state.

Because of application of the above technical solution, the present utility model has the following advantages compared to the prior art:

1. With the unique design of the table board of the present utility model, the table board is composed of the left table board and the right table board slidely connected with each other, and can be arbitrarily extended to get the length of the table board adjusted, consumedly enhancing versatility of the operation table, making it applicable on multiple occasions, that is, the table board can be used as a domestic mini scaffold or a vehicle washing table. On the other hand, with the adjustable length of the table board, the table board can be shorten to the smallest size while being folded, saving the storage space.

2. Because the telescopic positioning mechanism of the present utility model is constituted by the claw clutch and the rack cooperating with each other, there are numerous adjusting shift positions, substantially realizing infinitely variable adjustment, making an operator position at various lengths fully upon request.

3. Because the claw clutch adopted by the present utility model has a structure where the claw eccentrically swings, it is both reliable and convenient to position, simple in structure, and convenient in fabrication.

In the figures: 1. Table board; 2. support feet; 3. left table board; 4. right table board; 5. rack; 6. claw clutch; 7. claw; 8. spring; 9. tooth head; 10. unlocking operation handle; 11. tooth head socket; 12. locking operation handle; 13. bayonet; 14. seat body; 15. convex platform; and 16. chute.

DETAILED DESCRIPTION OF THE EMBODIMENTS

The present utility model will be further described below with reference to drawings and embodiments.

Figure 1:
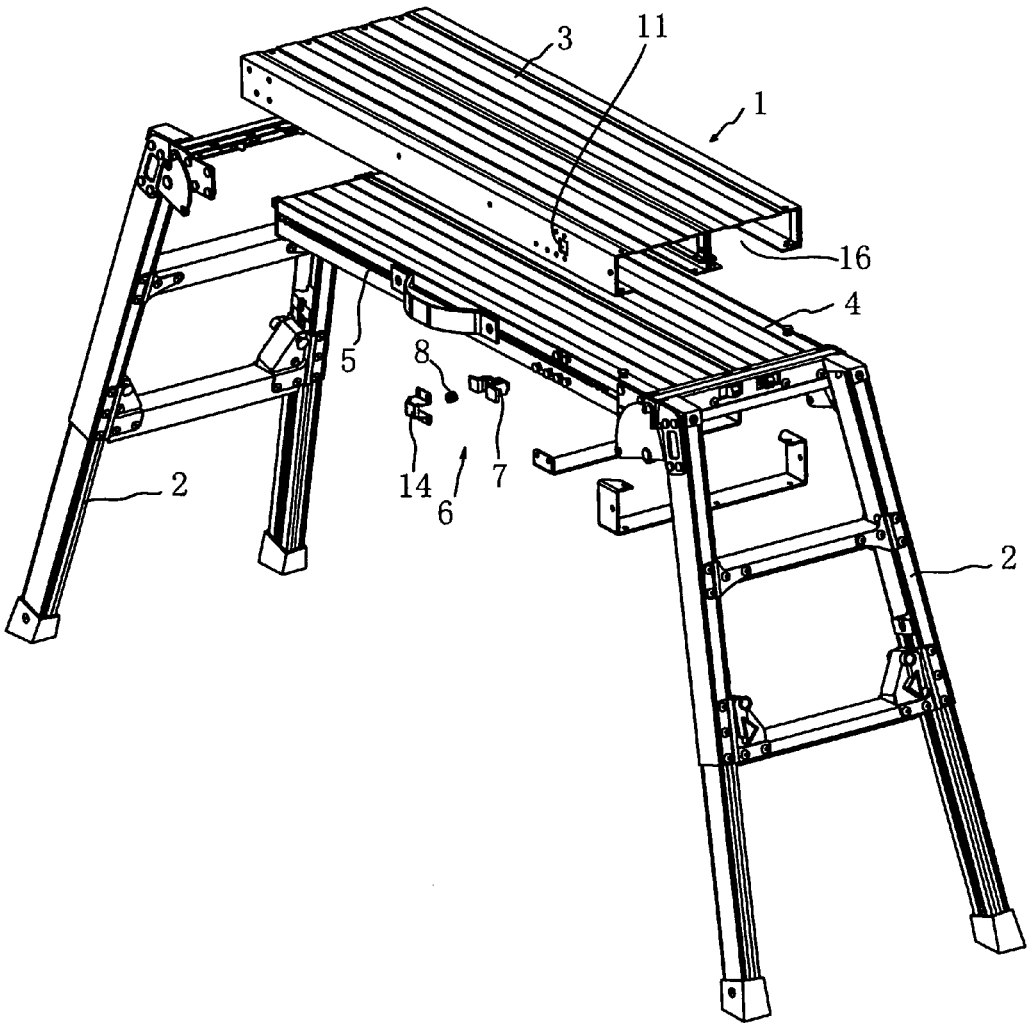
FIG. 1 is an exploded schematic view of the table board of the present utility model.
Figure 2:
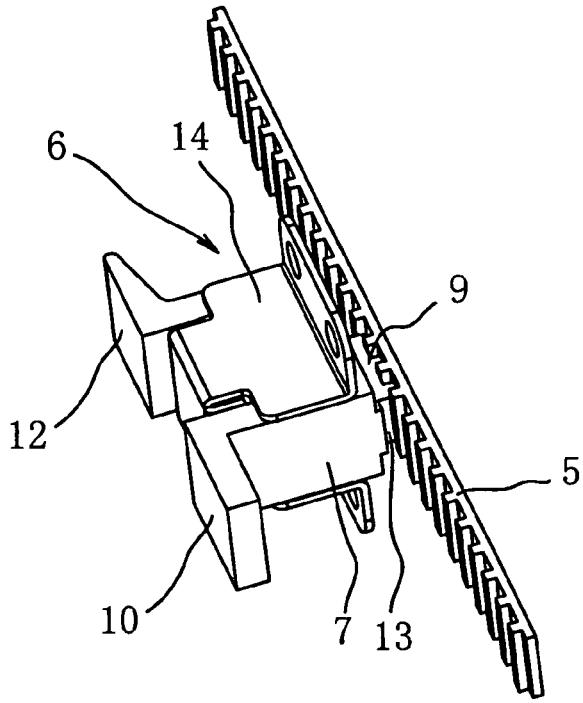
FIG. 2 is a stereoscopic schematic view of the telescopic positioning mechanism of the present utility model.
Figure 3:
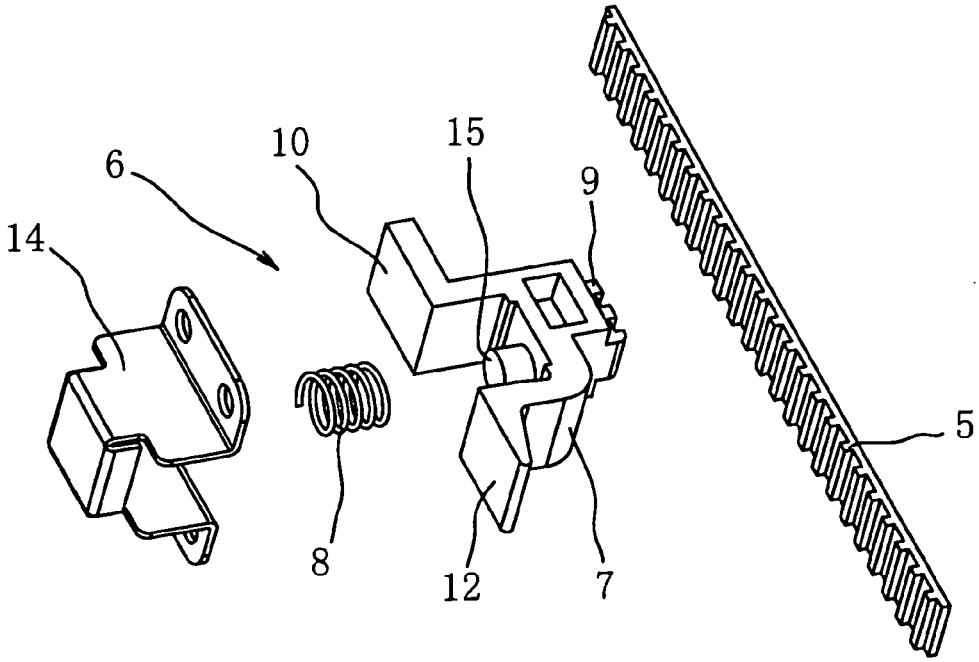
FIG. 3 is an exploded schematic view of various parts of the telescopic positioning mechanism of the present utility model.
Figure 4:
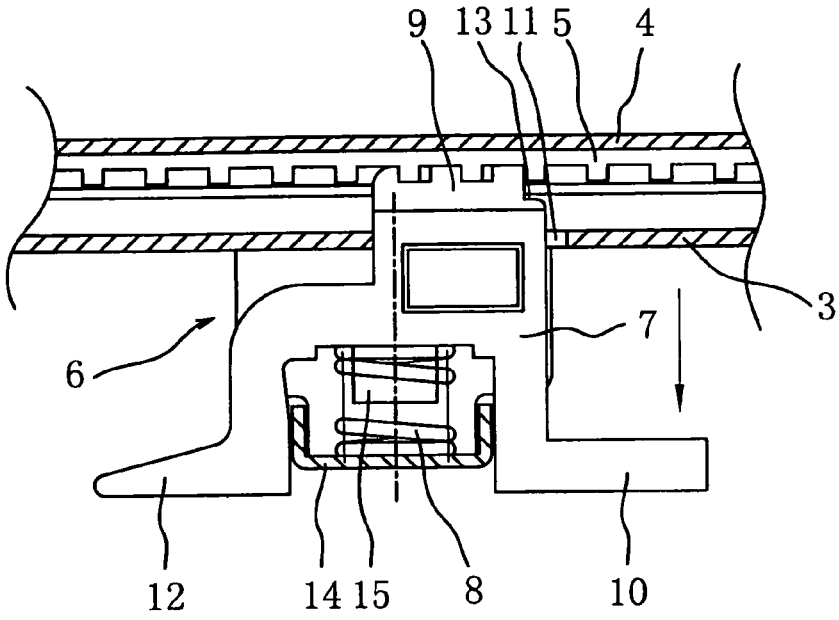
FIG. 4 is Schematic View 1 of the telescopic positioning mechanism of the present utility model in the working state, here it being in the locking state.
Figure 5:
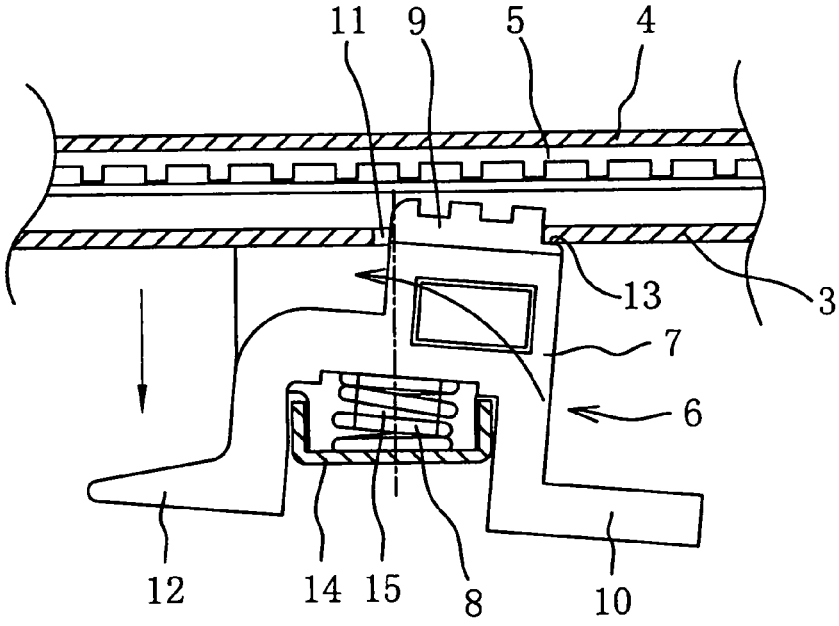
FIG. 5 is Schematic View 2 of the telescopic positioning mechanism of the present utility model in the working state, here it being in the unlocking state.
Figure 6:
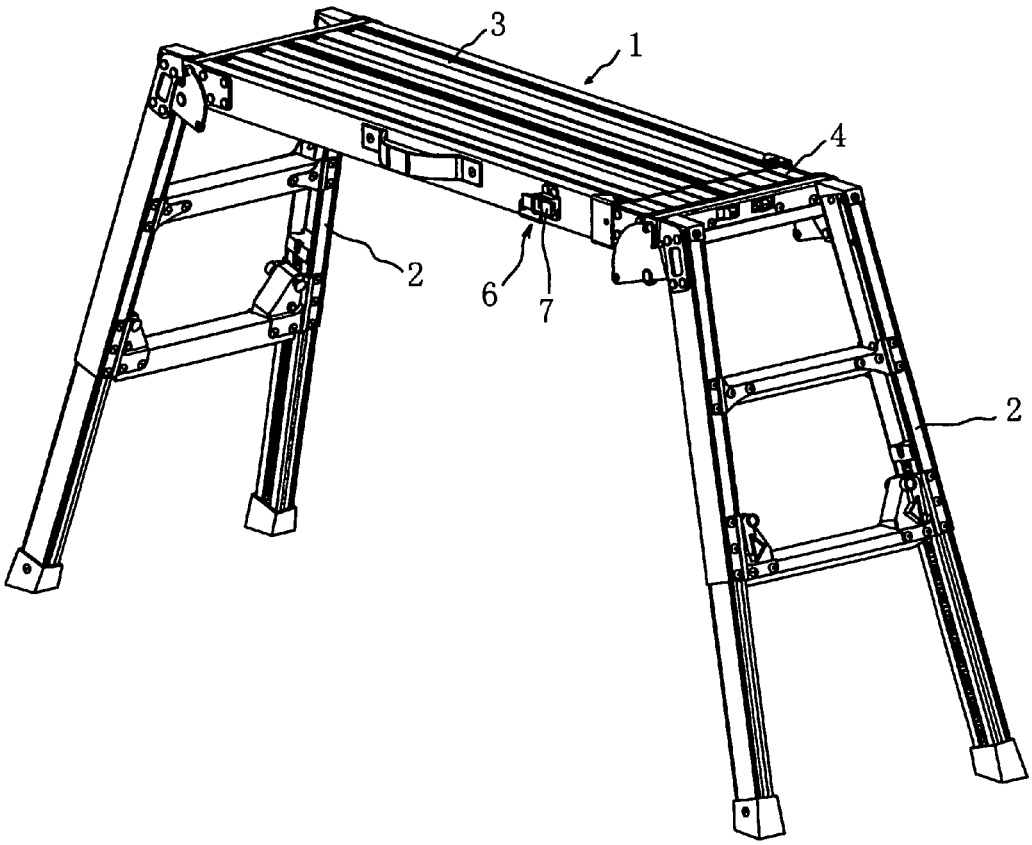
FIG. 6 is Overall Schematic View 1 of the present utility model, here the table board being in the retraction state.
Figure 7:
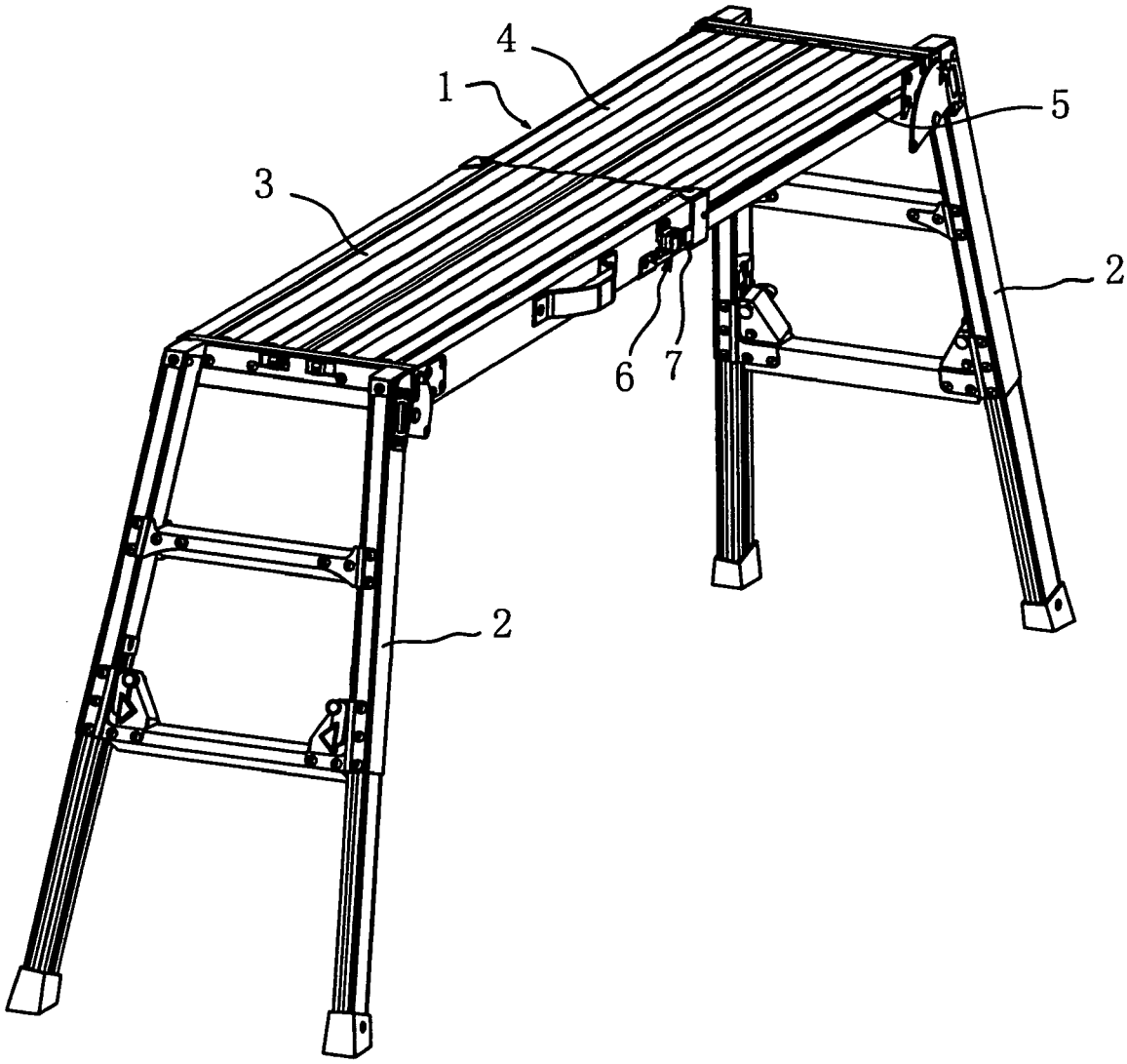
FIG. 7 is Overall Schematic View 2 of the present utility model, here the table board being in the expansion state.

Embodiment: As shown in FIGS. 1, 6 and 7, the present utility model provides an operation table with a telescopic table board positioned with an eccentric rocker. The operation table includes a table board 1 and support feet 2, the support feet 2 being positioned at both ends of the table board 1 along the length direction. The table board 1 is composed of a left table board 3 and a right table board 4, which are slidely nested with each other at the inner end, and connected at the outer end to the support feet 2 at both ends, respectively.

Between the left table board 3 and the right table board 4 is a telescopic positioning mechanism.

As shown in FIGS. 2 to 5, the telescopic positioning mechanism includes a rack 5 fixedly positioned on the side of the right table board 4 and a claw clutch 6 correspondingly positioned on the side of the left table board 3, the rack 5 and the claw clutch 6 cooperating with each other. The claw clutch 6 includes a claw 7, a spring 8 and a seat body 14. The claw 7 is provided at the head with a tooth head 9 engaged with the corresponding rack 5, and at the tail with an unlocking operation handle 10. The claw 7 is supported at the central part on the seat body 14 via the spring 8 vertical to the rack 5. The seat body 14 is fixed on the side of the left table board 3. The spring 8 acts in the same direction with the tooth head [9], that is, the spring forces the tooth head 9 to contact with the rack 5. Moreover, the tooth head 9 and the unlocking operation handle 10 are eccentrically positioned on the right side of the support center of the spring 8. The left table board 3 is provided on the side with a tooth head socket 11 corresponding to the tooth head 9 at the head of the claw 7. The tooth head 9 is engaged with the rack 5 on the right table board 4 through this tooth head socket 11. In order to facilitate operation, the claw 7 is provided at the central part with a locking operation handle 12 extending on the swing plane of the claw 7 toward the left side corresponding to the unlocking operation handle 10 on the right side, thus making the claw 7 in a " " form. The head of the claw 7 is provided on the side having the unlocking operation handle 10 with a bayonet 13, which fits the tooth head socket 11 at the edge to get stuck and positioned, thus constituting the positioning structure of the claw 7 in the unlocking state.

As shown in FIG. 1, the left table board 3 is provided on the lower surface with two chutes 16. The right table board 4 is composed of two front and rear table boards, which are slidely stuck in the two chutes 16, respectively, thus constituting slide connection.

The support feet 2 of this embodiment are rotatively connected with the table board 1, thus realizing the turning function of the support feet 2. Meanwhile the support feet are also provided at the lower end with telescopic feet, realizing the telescopic-foot function. These two structures are all prior arts, and will not be described here in detail.

The above embodiment is used only for explaining the technical concept and characteristics of the present utility model. It is provided to make those skilled in the art understand the present utility model and implement it, and cannot thereby limit the extent of protection of the present utility model. All equivalent changes or modifications according to the spirit of the present utility model should fall within the extent of protection of the present utility model.

What is claimed is:

1. An operation table with a telescopic table board positioned with an eccentric rocker, the operation table comprising:

a table board and support feet, the support feet being positioned at both ends of the table board along the length direction;

wherein:

the table board includes a left table board and a right table board, wherein the left table board and right table board each have an inner end and an outer end and the left table board and right table board are slidely nested with each other at the inner ends, and are connected at each respective outer end to the support feet;

one of the left table board and the right table board is fixedly provided with a rack and the other is provided with a corresponding claw clutch, which includes a claw and a spring;

the claw is provided at a first end with a tooth head engaged with the rack, and at a second end having two sides, a first side and a second side, the first side with an unlocking operation handle;

the claw is supported at a central part via the spring on the left table board or the right table board correspondingly provided with the claw clutch;

the spring acts in a same direction as the tooth head;

the tooth head and the unlocking operation handle are eccentrically positioned on one side of a support center of the spring, thus constituting a telescopic positioning mechanism between the left table board and the right table board one of the left and the right table boards is provided with a tooth head socket corresponding to the tooth head of the claw, and the tooth head is contactively engaged with the rack on the other table board through the tooth head socket; and wherein the first end of the claw is provided on the side having the unlocking handle with a bayonet, which fits the tooth head socket at an edge to get stuck and positioned, thus constituting the positioning structure of the claw in an unlocking state.

2. The operation table with the telescopic table board positioned with the eccentric rocker according to claim 1, wherein the claw is provided with the second end having the first side and the second side, at the central part extending toward the second side on athe swing plane of the claw with a locking operation handle symmetrical to the unlocking operation handle on the first side of the claw.

3. The operation table with the telescopic table board positioned with the eccentric rocker according to claim 1, wherein:

the claw clutch is provided with a seat body, on which the claw is supported at the central part via the spring; and the seat body is fixed on the left table board or the right table board correspondingly provided with the claw clutch.

4. The operation table with the telescopic table board positioned with the eccentric rocker according to claim 1, wherein the claw is provided at the central part with a convex platform, to which the spring is sleeved at one end.

5. The operation table with the telescopic table board positioned with the eccentric rocker according to claim 1, wherein the claw is fixedly connected at the central part with the spring at one end.

6. The operation table with the telescopic table board positioned with the eccentric rocker according to claim 1, wherein the spring is positioned vertically to the rack.

7. An operation table with a telescopic table board positioned with an eccentric rocker, the operation table comprising:

a table board and support feet, the support feet being positioned at both ends of the table board along the length direction;

wherein:

the table board includes a left table board and a right table board, wherein the left table board and right table board each have an inner end and an outer end and the left table board and right table board are slidely nested with each other at the inner ends, and are connected at each respective outer end to the support feet;

one of the left table board and the right table board is fixedly provided with a rack and the other is provided with a corresponding claw clutch, which includes a claw, a support center, and a spring;

the claw is provided at a first end with a tooth head engaged with the rack, and at a second end having two sides, a first side and a second side, the first side with an unlocking operation handle;

the claw is supported at a central part via the spring;

the spring acts in a same direction as the tooth head;

the tooth head and the unlocking operation handle are eccentrically positioned on one side of the support center of the spring, thus constituting a telescopic positioning mechanism between the left table board and the right table board;

one of the left and the right table boards is provided with a tooth head socket corresponding to the tooth head of the claw, and the tooth head is contactively engaged with the rack on the other table board through the tooth head socket; and wherein the claw is provided at the central part with a convex platform, to which the spring is sleeved at one end.

8. The operation table with the telescopic table board positioned with the eccentric rocker according to claim 7, wherein the first end of the claw is provided on the side having the unlocking handle with a bayonet, which fits the tooth head socket at an edge to get stuck and positioned, thus constituting the positioning structure of the claw in an unlocking state.

9. The operation table with the telescopic table board positioned with the eccentric rocker according to claim 7, wherein the claw is provided with the second end having the first side and the second side, the central part extending toward the second side on a swing plane of the claw with a locking operation handle symmetrical to the unlocking operation handle on the first side of the claw.

10. The operation table with the telescopic table board positioned with the eccentric rocker according to claim 7, wherein:

the claw clutch is provided with a seat body, on which the claw is supported at the central part via the spring; and the seat body is fixed on the left table board or the right table board correspondingly provided with the claw clutch.

11. The operation table with the telescopic table board positioned with the eccentric rocker according to claim 7, wherein the claw is fixedly connected at the central part with the spring at one end.

12. The operation table with the telescopic table board positioned with the eccentric rocker according to claim 7, wherein the spring is positioned vertically to the rack.

* * * * *